US006778007B2

(12) United States Patent
Lim

(10) Patent No.: US 6,778,007 B2
(45) Date of Patent: Aug. 17, 2004

(54) INTERNAL POWER VOLTAGE GENERATING CIRCUIT

(75) Inventor: Kyu-Nam Lim, Suwon (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 10/155,196

(22) Filed: May 24, 2002

(65) Prior Publication Data

US 2003/0085754 A1 May 8, 2003

(30) Foreign Application Priority Data

Nov. 2, 2001 (KR) ..... 2001-68197

(51) Int. Cl.[7] ..... G05F 1/10; G05F 3/02
(52) U.S. Cl. ..... 327/541; 327/543
(58) Field of Search ..... 327/538, 540, 327/541, 543, 545, 546; 323/312, 315, 316

(56) References Cited

U.S. PATENT DOCUMENTS 4,978,904 A * 12/1990 Fitzpatrick et al. ..... 323/313
5,081,380 A * 1/1992 Chen ..... 327/262
5,694,076 A * 12/1997 Ishibashi ..... 327/541
6,384,667 B1 * 5/2002 Bouvier ..... 327/535

* cited by examiner

*Primary Examiner*—Terry D. Cunningham
*Assistant Examiner*—Quan Tra
(74) *Attorney, Agent, or Firm*—F. Chau & Associates LLC

(57) ABSTRACT

An internal power voltage generating circuit capable of accurately adjusting a level of an internal power voltage in response to an overshoot of the internal power voltage. In one embodiment, the circuit comprises an internal power voltage generator for generating an internal power voltage to an internal power voltage generating terminal, first and second resistor devices, serially connected between the internal power voltage generating terminal and a ground voltage, for distributing the internal power voltage and for generating a distributed voltage to a distributed voltage generating node, and a current discharging device, connected between the internal power voltage generating terminal and the ground voltage, for discharging current from the internal power voltage generating terminal to the ground voltage in response to the distributed voltage.

18 Claims, 9 Drawing Sheets

(a)

(b)

INTERNAL POWER VOLTAGE GENERATING CIRCUIT

CROSS-REFERENCE TO RELATED APPLICATION

This application claims priority to Korean Patent Application No. 2001-68197 filed on Nov. 2, 2001.

BACKGROUND

1. Technical Field

The present invention relates to a semiconductor memory device, and more particularly, to an internal power voltage generating circuit for use in a semiconductor memory device.

2. Description of Related Art

Typically, an internal power voltage generating circuit for use in a semiconductor memory device detects a voltage difference between a reference voltage and an internal power voltage and controls the level of the internal power voltage based on the voltage difference.

FIG. 1 is a circuit diagram illustrating a conventional power voltage generating circuit for use in a semiconductor memory device. The internal power voltage generating circuit comprises a PMOS transistor P3, a capacitor $C_L$, and a current mirror type comparator 10 comprising PMOS transistors P1 and P2, NMOS transistors N1 and N2, and a constant current source Is. A load current $I_L$ represents current flowing through a load connected to an internal power voltage generating terminal.

When a reference voltage level VREF is greater than an internal power voltage level VINT, the NMOS transistor N1 is turned on and the current mirror type comparator 10 lowers the voltage of node A. The PMOS P3 transistor is turned on, and the current supplied to the internal power voltage generating terminal VINT is increased, thereby steadily raising the internal power voltage level VINT through the capacitor $C_L$.

Alternately, when the reference voltage level VREF is lower than the internal power voltage level VINT, the NMOS transistor N2 is turned on and the current mirror type comparator 10 raises the voltage of node A. The PMOS transistor P3 is turned off and the current supplied to the internal power voltage generating terminal VINT is decreased, thereby steadily lowering the internal power voltage level VINT through the capacitor $C_L$.

When the level of the load current $I_L$ becomes 0, the PMOS transistor P3 has to be turned off to prevent current flowing to the internal power voltage VINT. However, it takes time to turn off the PMOS transistor P3 after the level of the load current $I_L$ becomes 0, due to the comparing operation of the current mirror type comparator 10 for raising the gate voltage of the PMOS transistor P3. Thus, current flows through the PMOS transistor P3 during the time between the level of load current $I_L$ being 0 and the PMOS transistor P3 being turned off. Accordingly, the level of the internal power voltage is raised and an overshoot of the internal power voltage occurs in the internal power voltage generating circuit of FIG. 1.

FIG. 2 is a circuit diagram illustrating another conventional internal power voltage generating circuit. The internal power voltage generating circuit of FIG. 2 comprises NMOS transistors N3(1) to N3(n) in parallel connected between node B and a ground voltage, in addition to components of the internal power voltage generating circuit of FIG. 1.

Referring to FIG. 2, when the voltage of node B is greater than a voltage (n×Vth), the NMOS transistors N3(1) to N3(n) are turned on and the current flowing through the PMOS transistor P3 streams down to the ground voltage. Here, Vth denotes a threshold voltage of each of the NMOS transistors N3(1) to N3(n).

When the level of the load current $I_L$ becomes 0, the NMOS transistors N3(1) to N3(n) are turned on and the current flowing through the PMOS transistor P3 flows to the transistors N3(1) to N3(n), thereby lowering the internal power voltage VINT to a desired voltage level.

FIG. 3 is a graph illustrating a relationship between the internal power voltage and the current flowing to the NMOS transistors N3(1) to N3(n) based on the number of the NMOS transistors of FIG. 2.

For example, when one NMOS transistor is connected between node B and the ground voltage, current begins to flow through the NMOS transistor N3(1) at the internal power voltage of about 0.4 volts. When two NMOS transistors are connected between node B and the ground voltage, current begins to flow through the NMOS transistors N3(1), N3(2) at the internal power voltage of about 0.9 volts. When five NMOS transistors are connected between node B and the ground voltage, current begins to flow through the NMOS transistors N3(1) to N3(5) at the internal power voltage of about 3.5 volts.

That is, the level of the internal power voltage at which current begins to flow from node B to the ground voltage largely depends on the number of the NMOS transistors N3(1) to N3(n). Therefore, it is difficult to accurately set the internal power voltage level when an overshoot occurs.

For example, current begins to flow from node B to the ground voltage at the internal power voltage of about 0.9 volts when two NMOS transistors N3(1) to N3(2) are connected between node B and the ground voltage, whereas current begins to flow from node B to the ground voltage at the internal power voltage of about 1.7 volts when three NMOS transistors N3(1) to N3(2) are connected between node B and the ground voltage. Therefore, it is impossible to set the level of current flowing from node B to the ground voltage when the internal power voltage VINT becomes 1.3 volts.

SUMMARY OF THE INVENTION

It is an object of the present invention to provide an internal power voltage generating circuit capable of accurately adjusting a level of an internal power voltage in response to an overshoot of the internal power voltage.

According to an aspect of the present invention, an internal power voltage generating circuit comprises an internal power voltage generator for generating an internal power voltage to an internal power voltage generating terminal, first and second resistor devices, serially connected between the internal power voltage generating terminal and a ground voltage, for distributing the internal power voltage and for generating a distributed voltage to a distributed voltage generating node, and a current discharging device, connected between the internal power voltage generating terminal and the ground voltage, for discharging current from the internal power voltage generating terminal to the ground voltage in response to the distributed voltage.

According to another aspect of the present invention, an internal power voltage generating circuit comprises an internal power voltage generator for generating an internal power voltage to an internal power voltage generating terminal, a variable resistor device connected between the internal power voltage generating terminal and a ground voltage, for distributing the internal power voltage and for generating a distributed voltage to a distributed voltage generating node, and a current discharging device, connected between the internal power voltage generating terminal and the ground voltage, for discharging current from the internal power voltage generating terminal to the ground voltage in response to the distributed voltage.

According to another aspect of the present invention, an internal power voltage generating circuit comprises an internal power voltage generating means for generating an internal power voltage to an internal power voltage generating terminal, a first resistor means connected between the internal power voltage generating terminal and a distributed voltage generating node in which the internal power voltage is distributed, a second resistor means connected between the distributed voltage generating node and a ground voltage, the second resistor means comprising a variable resistance value, and a current discharging means, connected between the internal power voltage generating terminal and the ground voltage, for discharging current from the internal power voltage generating terminal to the ground voltage in response to the distributed voltage.

According to further aspect of the present invention, an internal power voltage generating circuit comprises an internal power voltage generating circuit for generating an internal power voltage to an internal power voltage generating terminal, a first resistor device connected between the internal power voltage generating terminal and a distributed voltage generating node for distributing the internal power voltage, a second resistor device connected between the distributed voltage generating node and a ground voltage, and a current discharging device connected between the internal power voltage generating terminal and the ground voltage and for discharging current from the internal power voltage generating terminal to the ground voltage in response to the distributed voltage.

These and other aspects, factors, and advantages of the present invention will become apparent from the following detailed description of preferred embodiments, which is to be read in conjunction with the accompanying figures.

DETAILED DESCRIPTION OF PREFFERED EMBODIMENTS

Figure 4:
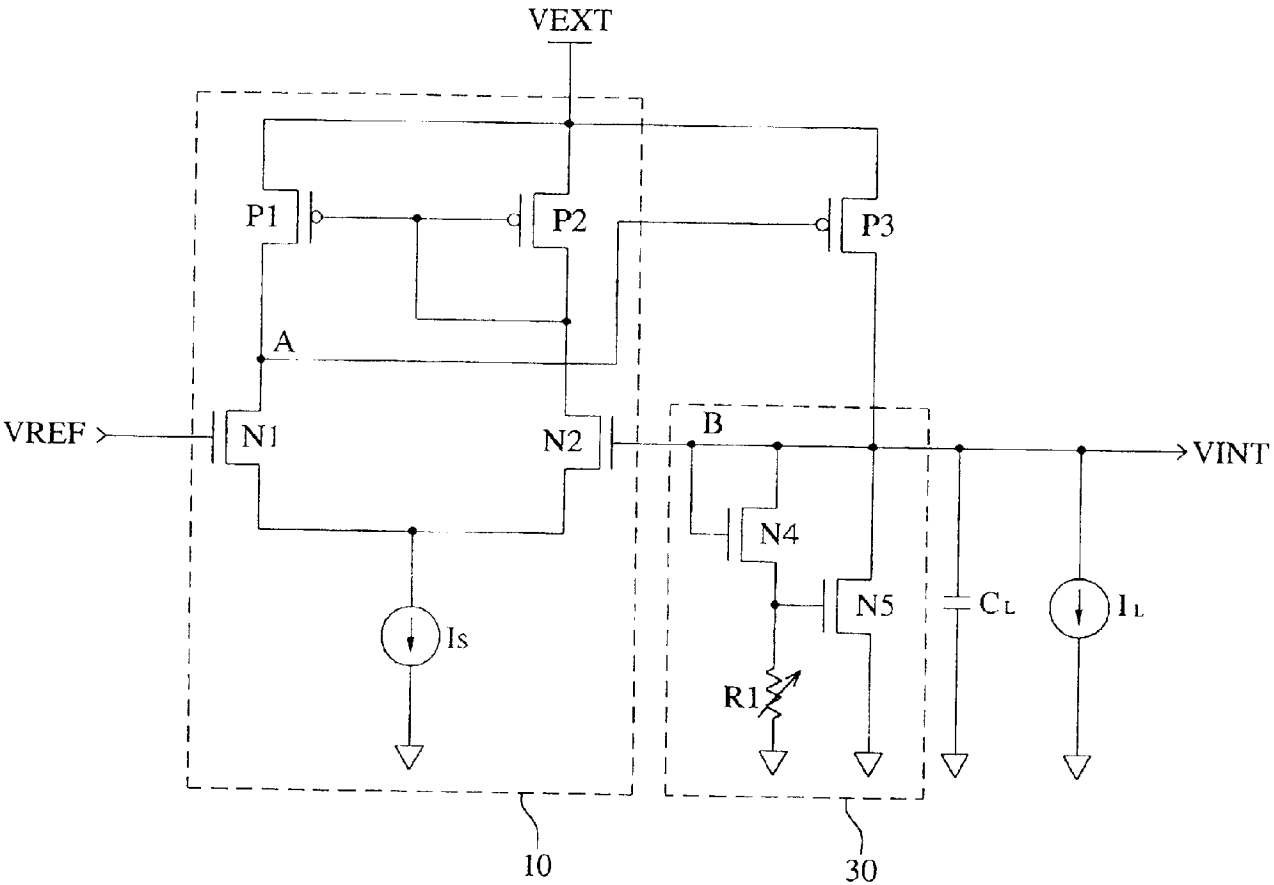
FIG. 4 is a circuit diagram illustrating an internal power voltage generating circuit according to one embodiment of the present invention.

FIG. 4 is a circuit diagram illustrating an internal power voltage generating circuit according to an embodiment of the present invention. The internal power voltage generating circuit of FIG. 4 comprises a current discharging circuit 30, in addition to components of the internal power voltage generating circuit of FIG. 1.

The current discharging circuit 30 comprises NMOS transistors N4 and N5, and a variable resistor R1. The NMOS transistor N4 comprises a gate and a drain connected to node B. The NMOS transistor N5 comprises a drain connected to node B, a source connected to the ground voltage, and a gate connected to a source of the NMOS transistor N4. The NMOS transistor N5 has a relatively large driving ability. The variable resistor R1 is connected between the gate of the NMOS transistor N5 and the ground voltage.

Figure 1:
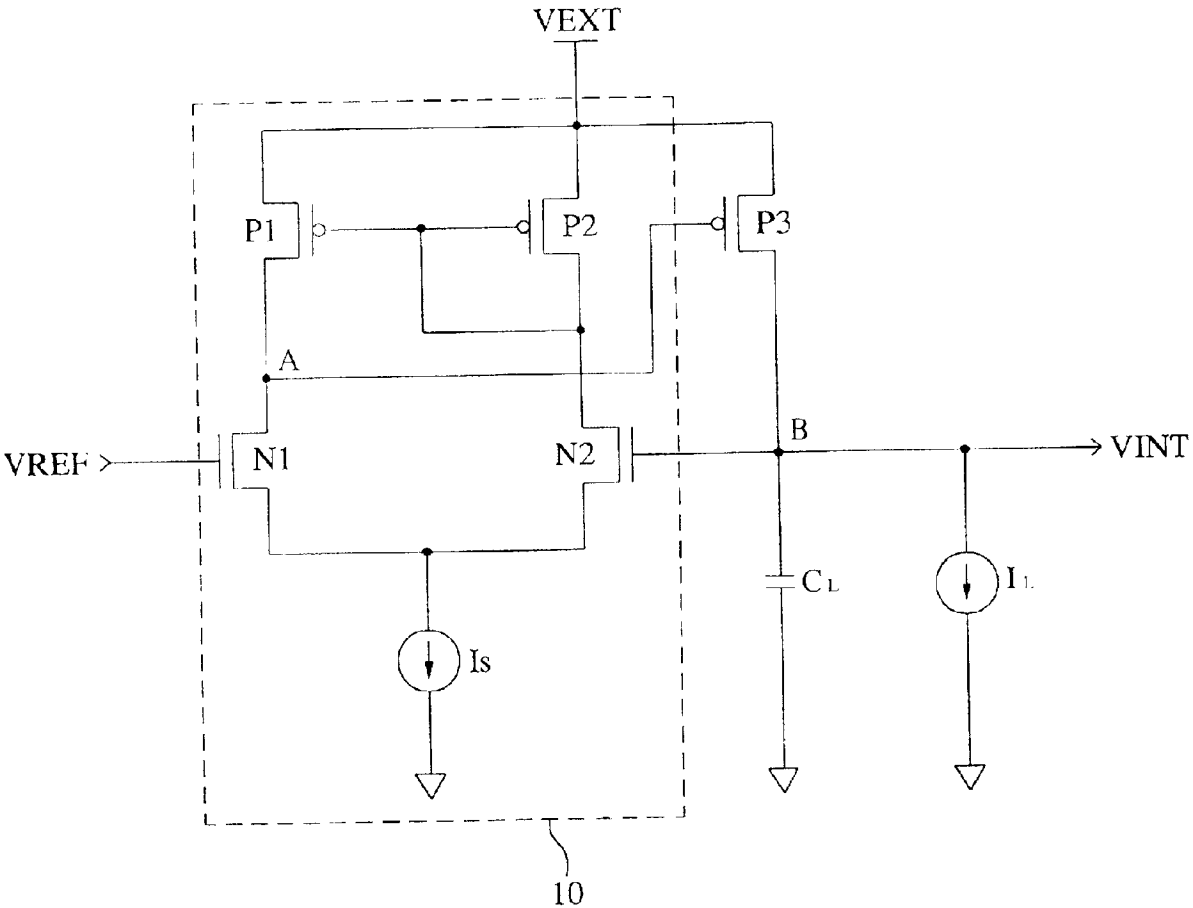
FIG. 1 (PRIOR ART)
FIG. 1 is a circuit diagram illustrating a conventional power voltage generating circuit for use in a semiconductor memory device.
Figure 2:
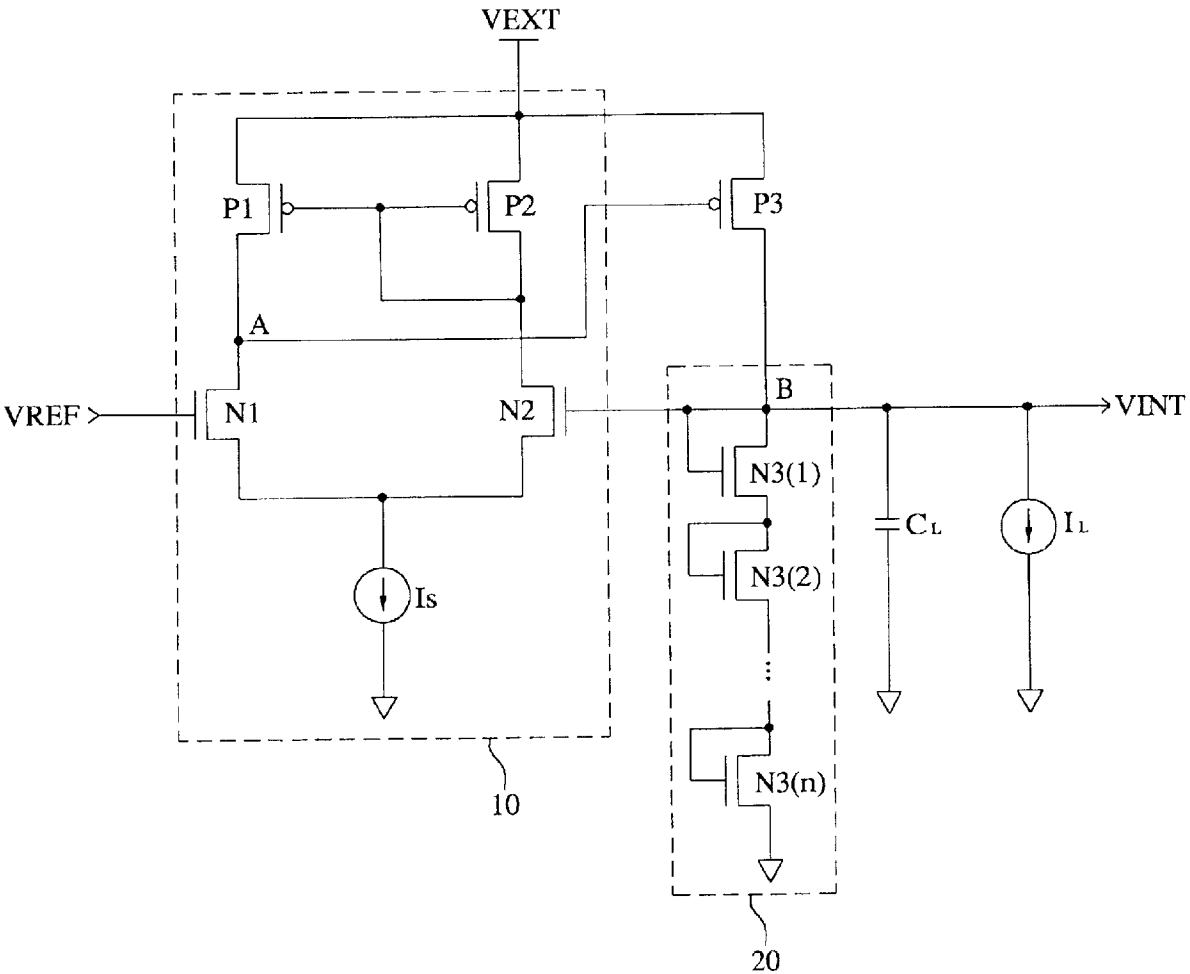
FIG. 2 (PRIOR ART)
FIG. 2 is a circuit diagram illustrating another conventional internal power voltage generating circuit.
Figure 3:
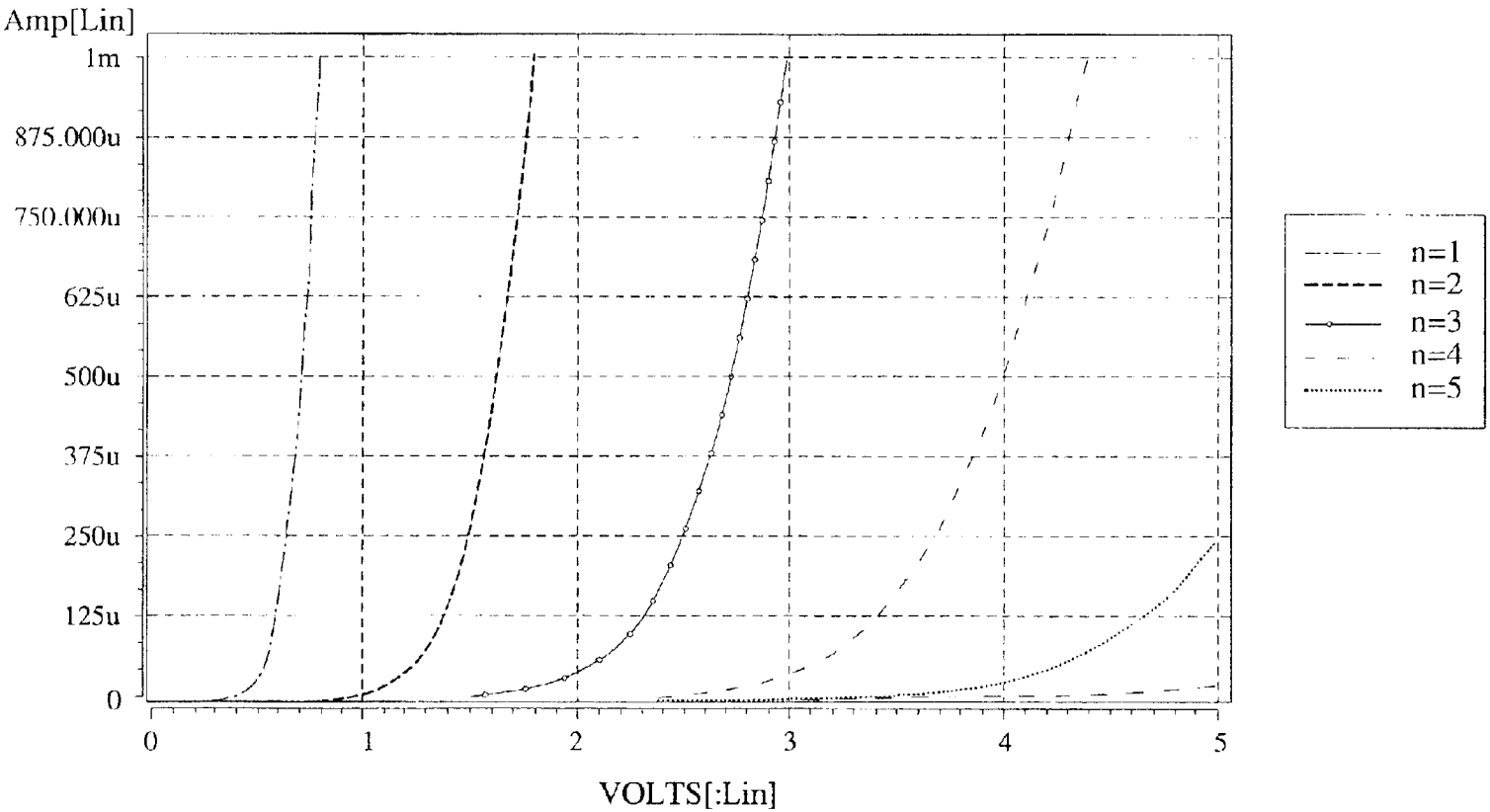
FIG. 3 is a graph illustrating a relationship between an internal power voltage and current flowing through the internal power voltage generating circuit of FIG. 2.

When there is no overshoot, the internal power voltage generating circuit of FIG. 4 performs the same operation as the internal power voltage generating circuit of FIG. 1.

When an overshoot occurs, the NMOS transistor N4 is turned on and a resistance value of the NMOS transistor N4 is decreased. Assume that a resistance value of the NMOS transistor N4 is R2, a voltage applied to the gate of the NMOS transistor N5 is "VINT×(R1/(R1+R2)". When this voltage is greater than a threshold voltage of the NMOS transistor N5, the NMOS transistor N5 is turned on and current flows from node B to the ground voltage. Therefore, the overshoot can be prevented.

The level of the internal power voltage at which current begins to flow from node B to the ground voltage in response to the occurrence of the overshoot is set to various values by varying a resistance value of the variable resistor R1.

Figure 5:
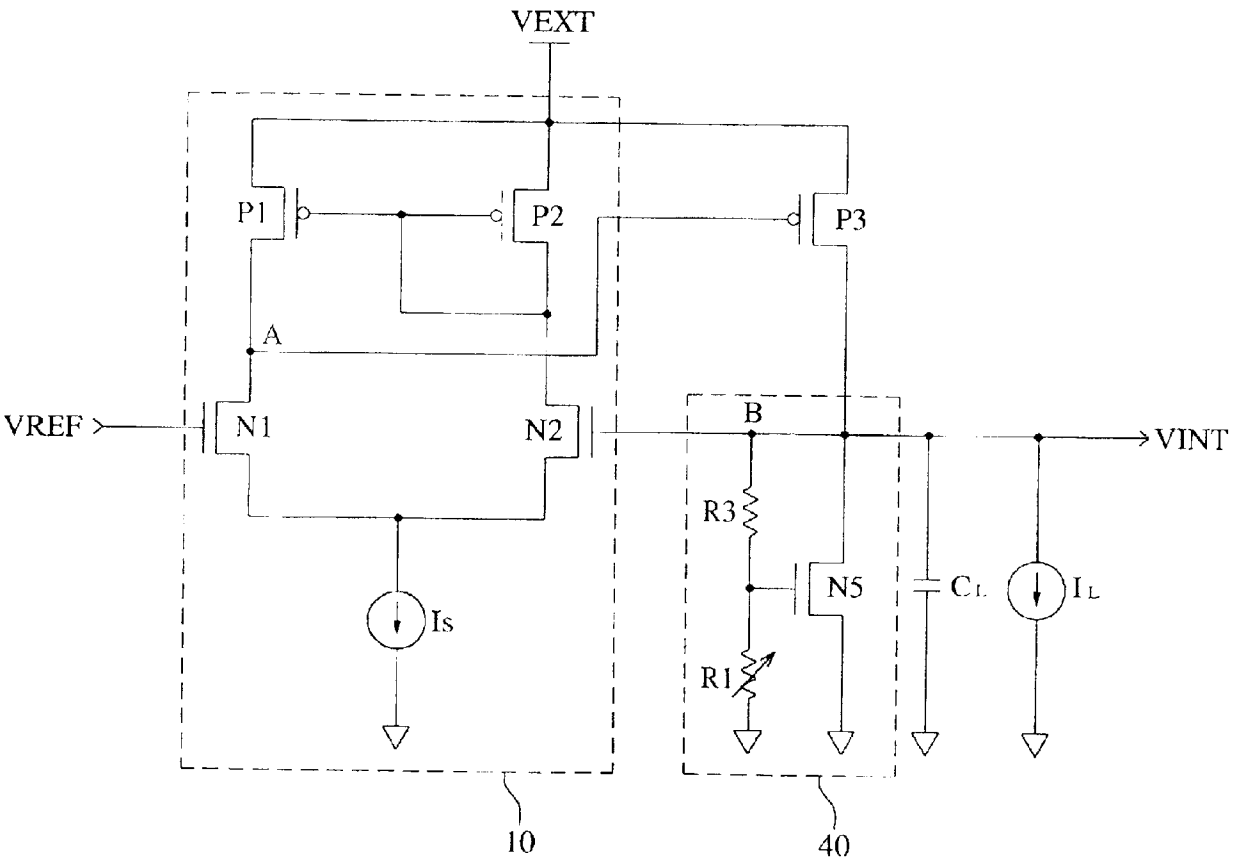
FIG. 5 is a circuit diagram illustrating an internal power voltage generating circuit according to another embodiment of the present invention.

FIG. 5 is a circuit diagram illustrating an internal power voltage generating circuit according to another embodiment of the present invention. The internal power voltage generating circuit of FIG. 5 comprises a resistor R3 instead of the NMOS transistor N4 of the internal power voltage generating circuit of FIG. 4.

Operation of the internal power voltage generating circuit of FIG. 5 can be understood by the description of the internal power voltage generating circuit of FIG. 4. The resistor R3 has a fixed resistance value. However, the resistor R3 may be replaced with a variable resistor.

Figure 6:
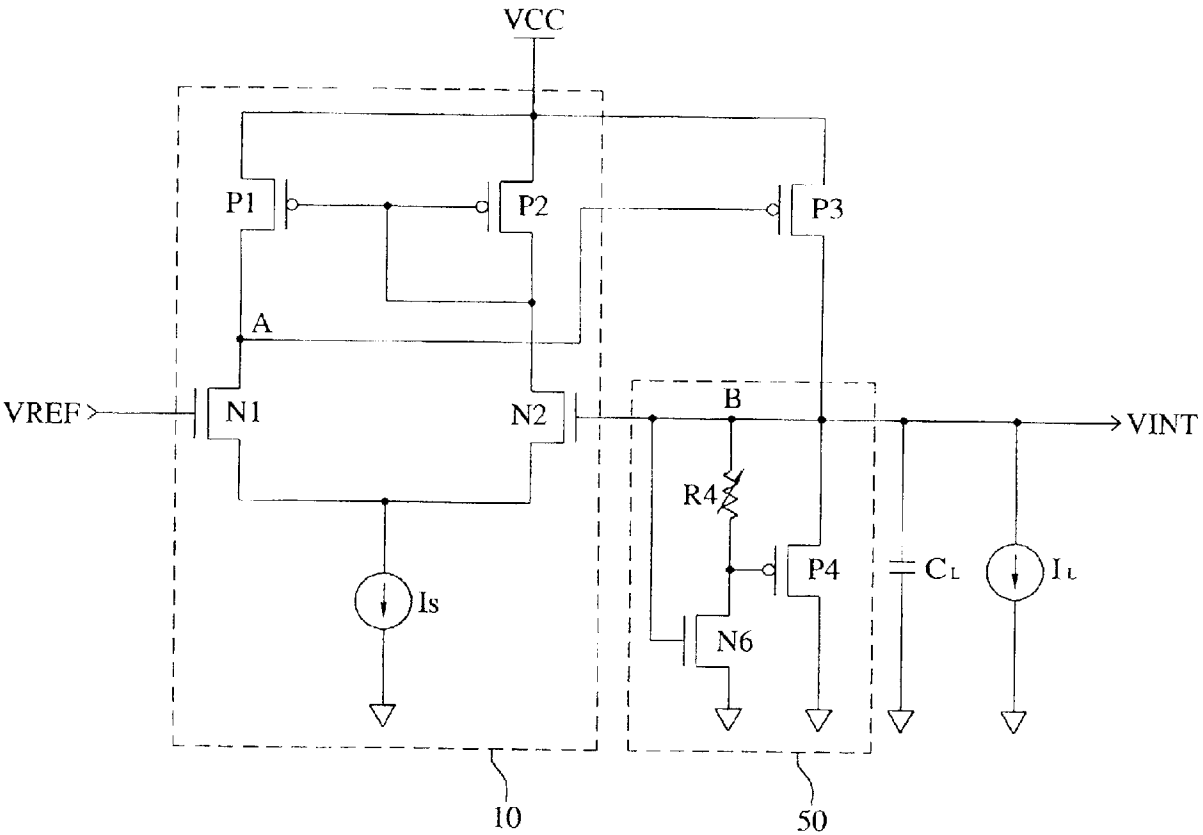
FIG. 6 is a circuit diagram illustrating an internal power voltage generating circuit according to another embodiment of the present invention.

FIG. 6 is a circuit diagram illustrating an internal power voltage generating circuit according to another embodiment of the present invention. The internal power voltage generating circuit of FIG. 6 comprises a current discharging circuit 50 in addition to components of the internal power voltage generating circuit of FIG. 1.

The current discharging circuit 50 comprises a variable resistor R4, an NMOS transistor N6, and a PMOS transistor P4. The PMOS transistor P4 comprises a source connected to node B and a drain connected to a ground voltage. The variable resistor R4 is connected between node B and a gate of the PMOS transistor. The NMOS transistor N6 comprises a drain connected to the gate of the PMOS transistor P4, a gate connected to node B, and a source connected to the ground voltage.

When there is no overshoot, the internal power voltage generating circuit of FIG. 6 performs the same operation as the internal power voltage generation circuit of FIG. 1.

When the overshoot of an internal power voltage occurs, the NMOS transistor N6 is turned on and a resistance value of the NMOS transistor N6 is decreased. Assume that a resistance value of the NMOS transistor N6 is R5, a voltage applied to the gate of the PMOS transistor P4 is "VINT× (R5/(R4+R5)". When this voltage is greater than the threshold voltage of the PMOS transistor P4, the PMOS transistor P4 is turned on and current flows from node B to the ground voltage. Therefore, the overshoot of the internal power voltage VINT can be prevented.

The level of the internal power voltage at which current begins to flow from node B to the ground voltage in response to the occurrence of the overshoot is set to various values by varying a resistance value of the variable resistor R4.

Figure 7:
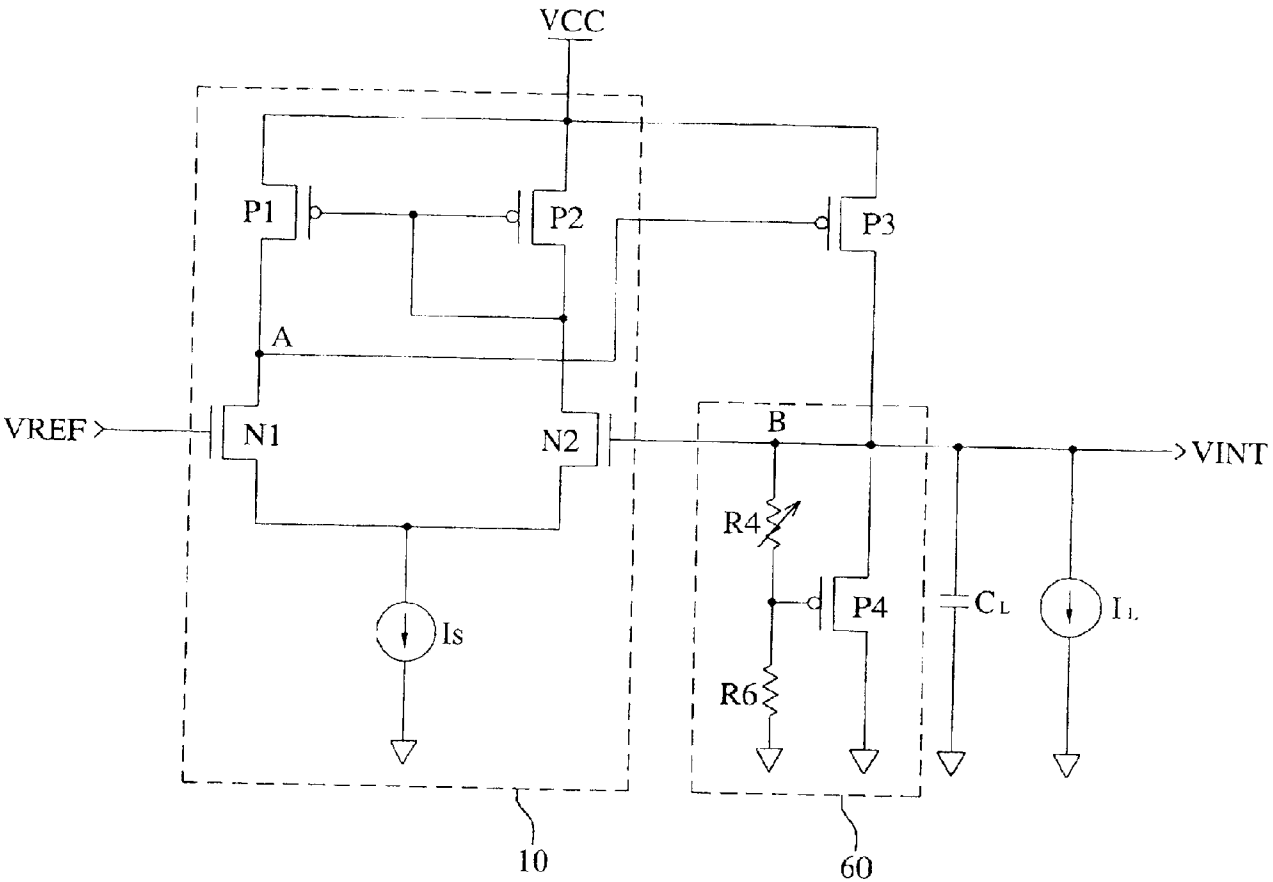
FIG. 7 is a circuit diagram illustrating an internal power voltage generating circuit according to another embodiment of the present invention.

FIG. 7 is a circuit diagram illustrating an internal power voltage generating circuit according to another embodiment of the present invention. The internal power voltage generating circuit of FIG. 7 comprises a resistor R6 instead of the NMOS transistor N6 of the internal power voltage generating circuit of FIG. 6.

Operation of the internal power voltage generating circuit of FIG. 7 can be readily understood by the description of the internal power voltage generating circuit of FIG. 6. The resistor R6 has a fixed resistance value. However, the resistor R6 may be replaced with a variable resistor.

Figure 8:
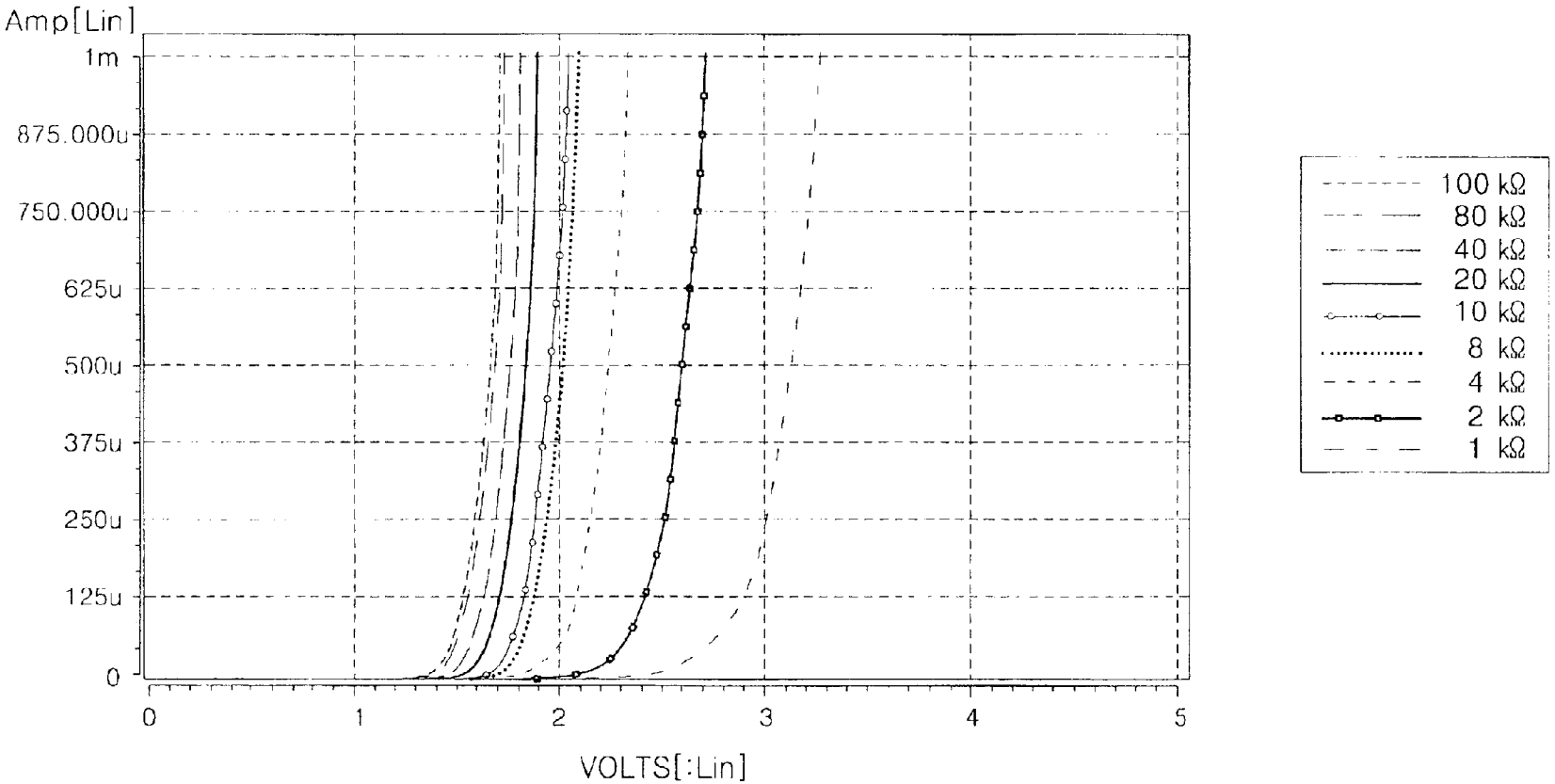
FIG. 8 is a graph illustrating a relationship between an internal power voltage and current based on a resistance value of a variable resistor of the internal power voltage generating circuit according to embodiments of the present invention.

FIG. 8 is a graph illustrating a relationship between an internal power voltage and current based on a resistance value of a variable resistor of the internal power voltage generating circuit according to embodiments of the present invention.

For example, when a resistance value of the variable resistor is set to 100 KΩ, current begins to flow at the internal power voltage level of about 1.1 volts. When a resistance value of the variable resistor is set to 80 KΩ, current begins to flow at the internal power voltage level of about 1.2 volts. When a resistance value of the variable resistor is set to 8 KΩ, current begins to flow at the internal power voltage level of about 1.4 volts.

As shown in FIG. 8, the internal power voltage generating circuit according to embodiments of the present invention can accurately adjust the internal power voltage level VINT (at which current begins to flow from the internal power voltage generating terminal to the ground voltage) in response to the occurrence of the overshoot of the internal power voltage occurs by varying a resistance value of the variable resistor.

Figure 9:
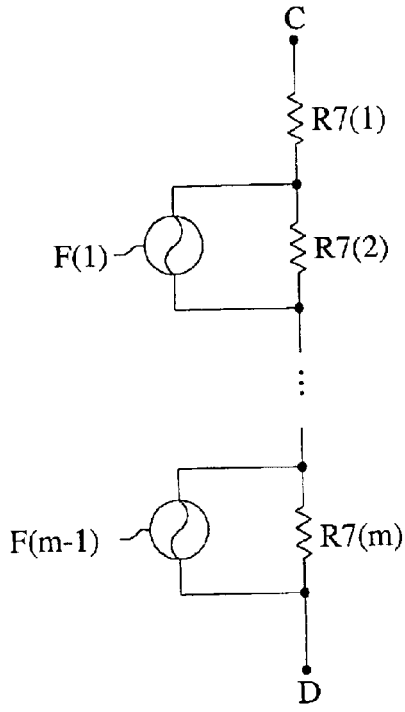
FIGS. 9A and 9B are circuit diagrams illustrating the variable resistor of the internal power voltage generating circuit according to embodiments of the present invention.
Figure 9:
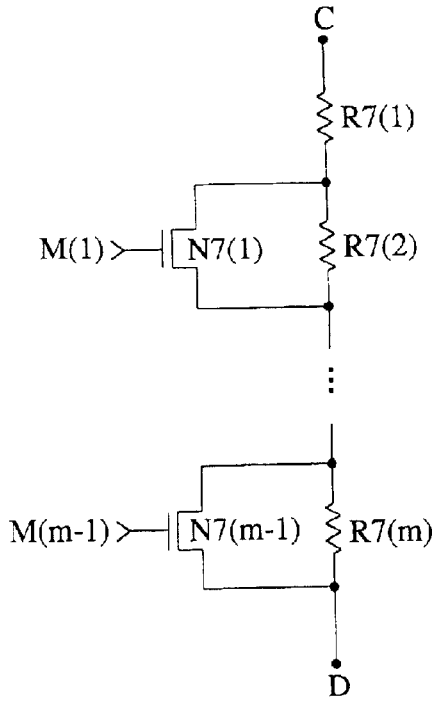

FIGS. 9A and 9B are circuit diagrams illustrating the variable resistors of the internal power voltage generating circuit according to embodiments of the present invention.

Referring to FIG. 9A, the variable resistor comprises a plurality of resistors R7(1) to R7(m) serially connected to each other between nodes C and D, and a plurality of fuses F(1) to F(m−1), each fuse being connected in parallel to the resistors R7(1) to R(7)m. A resistance value of the variable resistor of FIG. 9A is set to a desired value by blowing the fuses F(1) to F(m−1). The fuses F1 to F(m−1) may be replaced with a metal option.

Referring to FIG. 9B, the variable resistor comprises a plurality of resistors R7(1) to R7(m) serially connected to each other between nodes C and D and a plurality of NMOS transistors N7(1) to N7(m−1) each comprising a drain and a source connected to both ends of a corresponding resistor of the resistors R7(1) to R7(m).

A resistance value of the variable resistor of FIG. 9B is set to a desired value by turning on/off the NMOS transistors N7(1) to N7(m−1) in response to control signals M(1) to M(m−1). The control signals M(1) to M(m−1) are applied to the gates of the NMOS transistors N7(1) to N7(m−1) from an external mode setting register (not shown) of a semiconductor memory device, so that the NMOS transistors N7(1) to N7(m−1) are turned on or off.

Advantageously, the internal power voltage generating circuit according to embodiments of the present invention accurately adjusts the internal power voltage level (at which current begins to flow from the internal power voltage level to the ground voltage), in response to the occurrence of the overshoot of the internal power voltage, by using a variable resistor.

While the invention has been particularly shown and described with reference to preferred embodiments thereof, it will be understood by those skilled in the art that the foregoing and other changes in form and details may be made therein without departing from the spirit and scope of the invention.

What is claimed is:

1. An internal power voltage generating circuit, comprising:

an internal power voltage generator for generating an internal power voltage to an internal power voltage generating terminal;

first and second resistor devices, serially connected between the internal power voltage generating terminal and a ground voltage, for distributing the internal power voltage and for generating a distributed voltage to a distributed voltage generating node, wherein the first resistor device comprises a resistor; and a current discharging device, connected between the internal power voltage generating terminal and the ground voltage, for discharging current from the internal power voltage generating terminal to the ground voltage in response to the distributed voltage, wherein the current discharging device comprises a PMOS transistor connected between the internal power voltage generating terminal and the ground voltage, and having a gate connected to the distributed voltage node.

2. The circuit of claim 1, wherein the internal power voltage generator comprises:

a comparator for comparing a reference voltage with the internal power voltage to generate a comparing signal; and a current supplying circuit for supplying current to the internal power voltage generating terminal in response to the comparing signal.

3. The circuit of claim 1, wherein the resistor comprises a variable resistor.

4. The circuit of claim 1, wherein the second resistor device comprises a variable resistor.

5. The circuit of claim 4, wherein the variable resistor comprises:

a plurality of resistors serially connected between the distributed voltage generating node and the ground voltage; and a plurality of fuses, each fuse being connected in parallel to a corresponding one of the resistors.

6. The circuit of claim 4, wherein the variable resistor comprises:

a plurality of resistors serially connected between the distributed voltage generating node and the ground voltage; and a plurality of switching transistors, each switching transistor comprising a drain and a source respectively connected to both ends of a corresponding one of the resistors and a gate for receiving a control signal.

7. An internal power voltage generating circuit, comprising:

an internal power voltage generator for generating an internal power voltage to an internal power voltage generating terminal;

a variable resistor device connected between the internal power voltage generating terminal and a ground voltage, for distributing the internal power voltage and for generating a distributed voltage to a distributed voltage generating node, wherein the variable resistor device comprises a variable resistor and an NMOS transistor serially connected to the variable resistor, wherein the NMOS transistor comprises a gate connected to the internal power voltage generating terminal, a drain for receiving the distributed voltage, and a source connected to the ground voltage; and a current discharging device, connected between the internal power voltage generating terminal and the ground voltage, for discharging current from the internal power voltage generating terminal to the ground voltage in response to the distributed voltage.

8. The circuit of claim 7, wherein the variable resistor comprises:

a plurality of resistors serially connected between the internal power voltage generating terminal and the distributed voltage generating node; and a plurality of fuses, each fuses being connected in parallel to a corresponding one of the resistors.

9. The circuit of claim 7, wherein the variable resistor comprises:

a plurality of resistors serially connected between the distributed voltage generating node and the internal power voltage generating terminal; and a plurality of switching transistors, each switching transistor comprising a drain and a source respectively connected to both ends of a corresponding one of the resistors and a gate for receiving a control signal.

10. The circuit of claim 7, wherein the current discharging device comprises a PMOS transistor comprising a source connected to the internal power voltage generating terminal, a drain connected to the ground voltage, and a gate receiving the distributed voltage.

11. An internal power voltage generating circuit, comprising:

an internal power voltage generating circuit for generating an internal power voltage to an internal power voltage generating terminal;

a first resistor device connected between the internal power voltage generating terminal and a distributed voltage generating node for distributing the internal power voltage;

a second resistor device connected between the distributed voltage generating node and a ground voltage; and a current discharging device connected between the internal power voltage generating terminal and the ground voltage and for discharging current from the internal power voltage generating terminal to the ground voltage in response to the distributed voltage, wherein the current discharging device comprises a PMOS transistor in which a source is connected to the internal power voltage generating terminal, a drain is connected to the ground voltage, and a gate receives the distributed voltage.

12. The circuit of claim 11, wherein the first resistor device comprises a variable resistor.

13. The circuit of claim 12, wherein the variable resistor comprises:

a plurality of resistors serially connected between the internal power voltage generating terminal and the distributed voltage generating node; and a plurality of fuses, each fuse being connected in parallel to a corresponding one of the resistors.

14. The circuit of claim 12, wherein the variable resistor comprises:

a plurality of resistors serially connected between the internal power voltage generating terminal and the distributed voltage generating node; and a plurality of switching transistors, each switching transistor comprising a drain and a source connected to both ends of a corresponding one of the resistors, and a gate for receiving a control signals.

15. The circuit of claim 11, wherein the second resistor device comprises an NMOS transistor comprising a gate connected to the internal power voltage generating terminal, a drain connected to the distributed voltage generating node, and a source connected to the ground voltage.

16. The circuit of claim 11, wherein the second resistor device comprises a resistor.

17. An internal power voltage generating circuit, comprising:

an internal power voltage generator for generating an internal power voltage to an internal power voltage generating terminal;

a variable resistor device connected between the internal power voltage generating terminal and a ground voltage, for distributing the internal power voltage and for generating a distributed voltage to a distributed voltage generating node; and a current discharging device, connected between the internal power voltage generating terminal and the ground voltage, for discharging current from the internal power voltage generating terminal to the ground voltage in response to the distributed voltage, wherein the current discharging device comprises a PMOS transistor in which a source is connected to the internal power voltage generating terminal, a drain is connected to the ground voltage, and a gate receives the distributed voltage.

18. An internal power voltage generator circuit, comprising:

an internal power voltage generator for generating an internal power voltage to an internal power voltage generating terminal;

first and second resistor devices, serially connected between the internal power voltage generating terminal and a ground voltage, for distributing the internal power voltage and for generating a distributed voltage to a distributed voltage generating node; and a current discharging device, connected between the internal power voltage generating terminal and the ground voltage, for discharging current from the internal power voltage generating terminal to the ground voltage in response to the distributed voltage, wherein at least one of the first and second resistor devices comprises a variable resistor device that enables setting of a level of the internal power voltage at which the discharging current begins to flow in response to overshoot of the internal power voltage, wherein the first resistor device comprises a first NMOS transistor comprising a gate and a drain connected to the internal power voltage generating terminal and a source connected to the distributed voltage generating node, wherein the second resistor device is the variable resistor device, and wherein the current discharging device comprises a PMOS transistor in which a source is connected to the internal power voltage generating terminal, a drain is connected to the ground voltage, and a gate receives the distributed voltage.

* * * * *